US005160054A

United States Patent [19]

Nolte

[11] Patent Number: 5,160,054

[45] Date of Patent: Nov. 3, 1992

[54] TAMPER EVIDENT VENT SYSTEM FOR CONTAINERS

[75] Inventor: Paul A. Nolte, Memphis, Tenn.

[73] Assignee: Ingersoll-Rand Company, Woodcliff Lake, N.J.

[21] Appl. No.: 688,446

[22] Filed: Apr. 22, 1991

[51] Int. Cl.[5] ..... B65D 51/16

[52] U.S. Cl. ..... 220/374; 220/303; 220/214; 220/208; 220/319; 220/231

[58] Field of Search ..... 220/303, 366, 202, 208, 220/209, 214, 319, 374, 231

[56] References Cited

U.S. PATENT DOCUMENTS

| | | | |
|---|---|---|---|
| 1,960,532 | 5/1934 | Dunham | 220/85 |
| 2,100,168 | 11/1937 | Melrath | 220/214 X |
| 2,649,109 | 8/1953 | Samiran | 137/235 |
| 2,757,944 | 8/1956 | Krapp | 285/153 |
| 2,784,865 | 3/1957 | Rieke | 220/303 X |
| 2,843,161 | 7/1958 | Ward | 141/290 |
| 3,513,887 | 5/1970 | Limandri | 141/207 |
| 3,840,056 | 10/1974 | Bower | 141/59 |
| 3,923,192 | 12/1975 | Walters | 220/303 X |
| 4,136,796 | 1/1979 | Dubois et al. | 220/303 X |
| 4,310,102 | 1/1982 | Walter | 220/366 X |
| 4,337,875 | 7/1982 | Lyons | 220/366 X |
| 4,476,995 | 10/1984 | Bellino et al. | 220/374 X |
| 4,502,516 | 3/1985 | Shields | 141/290 |
| 4,552,283 | 11/1985 | Poldner | 220/303 X |
| 4,886,089 | 12/1989 | Gabrlik et al. | 220/202 X |
| 4,893,844 | 1/1990 | Chelette et al. | 285/113 |
| 4,949,878 | 8/1990 | Jacobi | 222/382 |

OTHER PUBLICATIONS 2 page advertisement CENTRYCO, Inc., P.O. Box 134, Wyncotte, Pa. 19095 "CENTRY VENT III" Automatic Safety Valve.

2 page advertisement JUSTRITE-Justrite Manufacturing Company, 2454 Dempster St., Des Plaines, Ill. 60016.

*Primary Examiner*—Allan N. Shoap
*Assistant Examiner*—Paul A. Schwarz
*Attorney, Agent, or Firm*—Michael H. Minns

[57] ABSTRACT

A vent system adapted to be installed on a standard container, in place of a shipping and storage plug, for use in venting the container without requiring any modification to the container. The vent system includes a knob which is turnable in one direction to place the vent system in a vent closed condition, as for example for shipping the container, and turnable in the opposite direction to place the vent system in a vent open condition to permit air to be vented into the container during fluid removal. A vent housing is adapted to be screwed into a threaded opening of the container. The knob includes a cap and a ring which are held together by a tamper evident seal. The knob is captured by the vent housing to prevent unwanted removal of the knob and to prevent unwanted access to the container. The tamper evident seal must be removed for access to the vent housing and for removal of the vent system from the container. An alternate embodiment has provisions for preventing leaking of fluid from the container through the vent system in the event the container is tipped.

10 Claims, 3 Drawing Sheets

TAMPER EVIDENT VENT SYSTEM FOR CONTAINERS

BACKGROUND OF THE INVENTION

1. Field of the Invention

The present invention relates, in general, to a vent system for use in venting containers.

2. Information Disclosure Statement

In containers of liquid, it is a common practice to have a vent in each of the containers so that during the dispensing of the liquid from the container the outside air can enter the container above the liquid to permit the liquid to flow freely from the container and prevent an air lock during such dispensing of the liquid. Typically, in addition to the opening through which the liquid from the container is dispensed, such containers have a threaded opening in which is threadedly received a vent cap or plug when the container is being stored or shipped and which is removed during dispensing of the liquid from the container to allow air to enter the container.

Also, in typical containers for liquids, particularly those containers which contain chemicals and the like and which are returned to the chemical supplier for a refill, it is desirable to have a means for indicating when the container has been tampered with and for preventing unwanted access to the container.

There have heretofore been other vent assemblies for containers, but the prior art vent assemblies of which applicant is aware have certain drawbacks, namely: (1) In the open position the vents allow water into the container. Thus, when it rains, the rain has a direct path into the container, allowing water to enter the container, which contaminates the chemicals in the container. (2) Once the vent is open, if the container tips over, the liquid leaks from the container. (3) When a vent assembly employing a ratchet mechanism to evidence tampering access to the container is used, the container requires special modifications. Also, such ratchet assemblies are not reusable since a part is broken off when the device is unscrewed. Thus, after the tampering has taken place, it is necessary to throw the whole device away. (4) Many prior vents required a wrench to open and close the vent since these prior vents used plastic against plastic or a flat gasket for the sealing portions of the vent. (5) Also, the plugs of many prior devices have a hex head which projects upwardly for turning by a wrench or by one's fingers, but with such plugs the advantages of a low profile are lost.

Applicant has knowledge of the following patents which may relate to the present invention: Samiran, U.S. Pat. No. 2,649,109, issued Aug. 18, 1953; Krapp, U.S. Pat. No. 2,757,944, issued Aug. 7, 1956; Ward, U.S. Pat. No. 2,843,161, issued Jul. 15, 1958; Limandri, U.S. Pat. No. 3,513,887, issued May 26, 1970; Bower, U.S. Pat. No. 3,840,056, issued Oct. 8, 1974; Shields, U.S. Pat. No. 4,502,516, issued Mar. 5, 1985; Chelette, U.S. Pat. No. 4,893,844, issued Jan. 16, 1990; Dunham, U.S. Pat. No. 1,960,532, issued May 29, 1934; and Jacobi, U.S. Pat. No. 4,949,878, issued Aug. 21, 1990.

Samiran discloses a nozzle for fuel servicing systems for aircraft. The sleeve of the nozzle is rotated about ninety degrees to lock the nozzle to the aircraft by a bayonet type joint. Pulling o the trigger of the nozzle operates certain valves and the fuel saturated air is forced out of the aircraft tank by the incoming fuel and returned to the top of the truck tank.

Krapp discloses a self-venting separable coupling. It has means to vent a system containing the female and male coupling without separating them. This is done by raising one of the levers only.

Ward discloses a tank filling nozzle. The tank filling nozzle has an inlet and a vent. A lever is movable to close off the space (i.e., seal) between the nozzle and the tank opening and opens the passageway to the vent.

Limandri discloses an automatic shut-off closed circuit coupling in which fluid connection is established between a nozzle and an adapter in the filling neck of a vehicle. When the connection is made, valves in both the nozzle and adapter are automatically opened. When the tank is filled to the desired level, vacuum is destroyed in the vent line causing shut off of the fuel flow. Separation of the nozzle closes all valves.

Bower discloses an apparatus for filling liquid storage tanks. The vent device has an input opening, a first discharge port, a second discharge port, a vapor adapter, and a closure cap. A flange forces a valve stem to the open position when the closure cap is in a position closing the end of the valve adapter. The vent device provides the means for limiting the amount of liquid which will be filled into a storage tank in order to permit the liquid trapped within any of the lines leading to or from the storage tank, as a result of filling, to drain into the tank after the filling operation has been terminated.

Shields discloses a vented fuel tank filler. The fill coupling, made up of fixed and movable members, respectively, is preferably of the interlocked dry break type. The members are opened by moving a handle. There is a mechanical interlock to prevent opening of the valve elements until the elements are connected and the mechanical interlock is rotated by a slight relative rotation of the coupling elements. There are guide rods to insure alignment of the couplings. The vent coupling is made up of members of the two way socket and plug type. Advancement of the parts opens the vent valves, then a slight turn of the supply line and attached movable fill coupling releases the interlock. The only turning movement of the valve members is to release the interlock. The handle causes the valve members to move towards one another.

Chelette discloses a tubular coupling with a ventable seal. The tubular coupling forms a self-energizing seal between two tubular members with the seal engaging in response to pressure from a primary direction while venting to pressure from a secondary direction, thereby maintaining the integrity of the metal-to-metal seal and thread annulus.

Dunham discloses a nonrefilling device for liquid containers. After the container has been filled, a plug is threaded in place and welded. There is a check valve mounted within the valve body and an air vent passage which is opened when the check valve is opened, allowing air inflow into the container from the outside air when liquid is withdrawn from the container.

Jacobi discloses a reusable container system. The top wall of the container has a pair of openings therein, one of which constitutes a port through which liquid may be removed from the container and the other constituting a port through which liquid may be delivered to the container, the latter port also functioning as a vent for venting the container as it is filled and emptied. There are tamper-evident means provided in the closures of the two ports for detecting any unauthorized attempts to refill the container.

Also, applicant has knowledge of a two page advertisement of Centryco, Inc. illustrating a CENTRY VENT III automatic safety valve which may be relevant to the present invention and which discloses a vent valve that operates to relieve the vacuum when fluid is withdrawn from the drum. Atmospheric pressure against a disc in the valve compresses a light spring and opens internal ports to break the vacuum.

In addition, applicant has knowledge of a two page advertisement of Justrite Manufacturing Company illustrating various drum vents which may be relevant to the present invention and which discloses a non-metallic dual action drum vent, a brass dual action drum vent, and an end of drum bung vent. Each of the vents are provided with a pressure relief, and with a vacuum relief for "assuring even flow during dispensing operations".

SUMMARY OF THE INVENTION

The present invention is directed toward providing an improved vent system for containers which overcomes previous problems and drawbacks of prior vent systems. The vent system includes a knob which is turnable in one direction to place the vent system in a vent closed condition, as for example for shipping the container, and turnable in the opposite direction to place the vent system in a vent open condition to permit air to be vented into the container during fluid removal. A vent housing is adapted to be screwed into a threaded opening of the container. The knob includes a cap and a ring which are held together by a tamper evident seal.

The knob is captured by the vent housing to prevent unwanted removal of the knob and to prevent unwanted access to the container. The tamper evident seal must be removed for access to the vent housing and for removal of the vent system from the container. An alternate embodiment has provisions for preventing leaking of fluid from the container through the vent system in the event the container is tipped.

One of the objects of the present invention is to provide a tamper evident vent system in which the vent of air from the outside atmosphere to the inside of a container with which the vent system is used may be quickly and easily opened and closed by hand, without the use of tools or the like, and yet shows evidence of unauthorized removal or tampering.

A further object is to provide a vent system in which the tamper evident feature is independent of the container and can be installed therein without modifying the container.

A further object is to provide a vent system which is not destroyed when tampered with but may be used again.

A further object is to provide a vent system which presents a low profile that does not project upwardly beyond the outer rim of the container so that it does not interfere with stacking or shipping of the containers.

A further object is to provide a vent system which protects against rain water or the like entering the container when the vent is open and protects against spillage of liquid from the container in the event the container tips over.

DESCRIPTION OF THE PREFERRED EMBODIMENT

Figure 1:
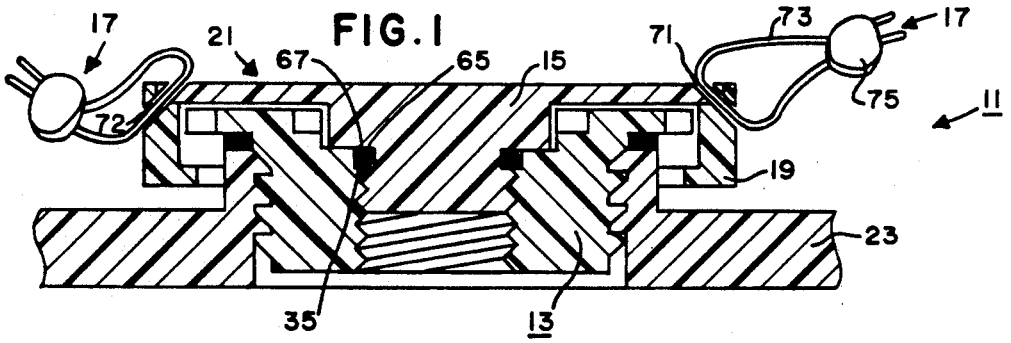
FIG. 1 is a vertical cross-sectional view through the center of the vent system of the present invention installed on a container, and with the vent system shown in a vent closed condition.

The vent system 11 of the present invention comprises, in general, a vent housing 13, a vent top or cap 15, a tamper evident sealing means 17, and a ring 19. Vent housing 13, vent cap 15, and ring 19 are preferably plastic, i.e., polyethylene or nylon, depending on the resistance needed to chemicals with which vent system 11 will be in contact. Sealing means 17 engages cap 15 and ring 19 to lock cap 15 and ring 19 together, thereby defining a locked condition, to establish a manually actuated operator 21.

A typical drum or container 23, with which vent system 11 is adapted to be used, may include a neck portion 25 provided with a threaded opening 27 extending into the interior of container 23 from the outside atmosphere. Normally, container 23, when used for containing chemicals, is formed of plastic and typically has in addition to the threaded opening 27 another opening, not shown, for use through which the liquid in the container is dispensed. Otherwise, container 23 is a closed container. Also, typically, threaded opening 27 is provided with an externally threaded plug to close off the threaded opening 27 during shipping, storage, or the like. The same is true for the other opening, not shown, in container 23. It should be noted that opening 27 is not required to be modified from its typical standard configuration, nor are any attachment means required to be added onto container 23, in order to receive vent system 11, as vent system 11 simply replaces the externally threaded shipping and storage plug.

Vent housing 13 is provided with a central opening 29 which has an internally threaded portion 31, an enlarged unthreaded portion 33 establishing a valve seat 35, and a further enlarged unthreaded portion 37. Opening 29 extends from the top to the bottom of vent housing 13. Vent housing 13 includes a neck portion 39 through which opening 29 extends. Neck portion 39 is provided with external threads 41 which are sized to fit and threadedly engage the threaded opening 27 in the container 23 with which vent system 11 may be used. In addition, vent housing 13 is provided with a peripheral vent housing flange 43 which extends outwardly from the neck portion 39 adjacent the upper end of the vent housing. Flange 43 is larger in diameter than the lowermost portion 45 of the central opening 47 through ring 19. Ring 19 has an inwardly extending flange 49 defining the lower-most portion 45 of opening 47. Opening 47 includes an enlarged portion 51 above portion 45 and a further enlarged portion 53 above portion 51, which portion 53 establishes a circular seat 55.

Cap 15 includes a stem 57 as well as a peripheral circular flange 59 outwardly extending from stem 57 adjacent the upper part thereof. Stem 57 includes an externally threaded portion 61 sized to threadedly engage the internally threaded portion 31 of vent housing 13. Stem 57 also includes an enlarged portion 63 sized to be received in the unthreaded portion 37 of vent housing 13. A circular groove 65 is provided in stem 57, above threaded portion 61, to receive an O-ring 67 which is adapted to seat against valve seat 35 when vent system 11 is in a vent closed condition to close off passageway means 69 extending through vent system 11.

Vent cap 15 is provided with a plurality of holes 71 adjacent the periphery of flange 59. There are preferably, though not necessarily, four holes 71 spaced at ninety degree intervals around the periphery of flange 59. Holes 71 preferably angle downwardly and outwardly and are adapted to align with a like plurality of holes 72 in the upper portion of ring 19 to receive sealing means 17. The sealing means 17 may be of any known type of tamper evident sealing means, such as the leaded wire type illustrated in the drawings, each of which includes a wire 73 and a piece of lead 75, which is sealed in a manner well known to those skilled in the art after the wire 73 is passed through the aligned holes 71, 72. Alternatively, if desired, a so-called "wire tie," well known to those skilled in the art, can be inserted through the aligned holes 71, 72 and secured to provide the tamper evident sealing means. With the sealing means 17 engaging cap 15 and ring 19 as above described, it will be understood that the ring 19 and cap 15 are locked together to establish the operator 21. Gripping means is provided in operator 21, preferably in the form of depressions 77 spaced around the periphery of ring 19, to act as finger grips for the manual turning actuation of knob means 21.

A plurality of notches 79, preferably four in number and spaced ninety degrees apart, are provided in the flange 43 of vent housing 13 for purposes later to be described. A like plurality of notches 81 are provided in the upper surface of vent housing 13, projecting radially outward from portion 37 of central opening 29 in the vent housing.

A plurality of notches 83, preferably four in number and spaced ninety degrees apart, are provided in stem 57 of cap 15 adjacent the peripheral lower edge thereof for a purpose later to be described.

To install vent system 11 on a container such as container 23, the ring 19 is placed over neck portion 25 with the neck portion 25 extending upwardly through opening 47. Then the vent housing 13 is screwed into threaded opening 27 of neck portion 25 so that a gasket 85, provided on vent housing 13 beneath flange 43, engages the upper end 87 of neck portion 25. A standard tool, such as a wrench, not shown, may be received by the notches 81 on vent housing 13 to turnably tighten or screw the vent housing against neck portion 25 for ensuring that there is no leakage of air or liquid between the vent housing 13 and the neck portion 25. It will be understood that after the vent housing 13 is screwed into place as above described, the ring 19 is captured against removal from neck portion 25 because flange 43 is larger than the lower-most portion 45 of opening 47 and because the flange 49 will engage flange 43 if removal of the ring 19 is attempted.

Next, cap 15 is placed adjacent vent housing 13, in concentric alignment therewith, and ring 19 is raised so that seat 55 meets flange 59 with holes 71 and 72 in alignment. The tamper evident sealing means 17 are then installed, as previously described, to lock the ring 19 and cap 15 together and establish operator 21. Also, it will be understood that since the ring 19 is captured against removal from neck portion 25 as heretofore described, the operator 21 is also captured against removal from neck portion 25.

Figure 2:
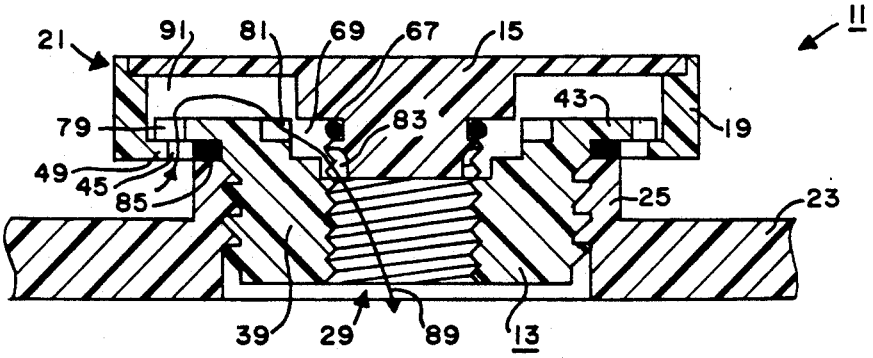
FIG. 2 is a cross-sectional view of the vent system similar to FIG. 1 but with the vent system shown in a vent open position.
Figure 3:
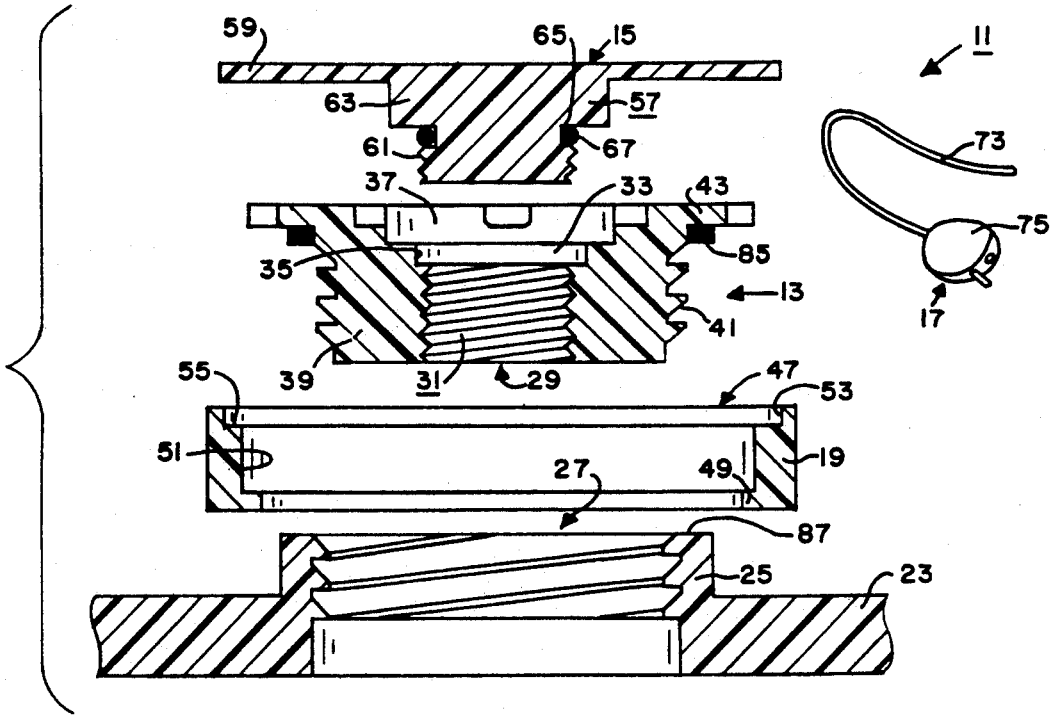
FIG. 3 is an exploded view of that shown in FIG. 2.
Figure 4:
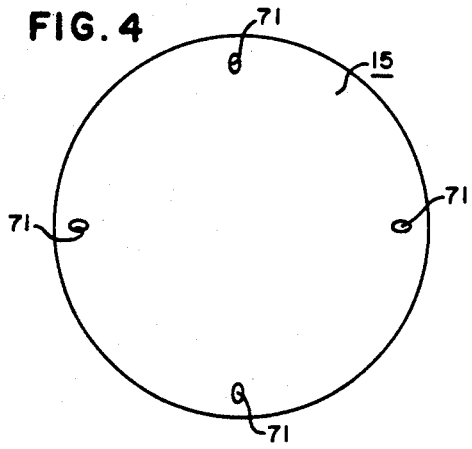
FIG. 4 is a plan view of the vent cap of the present invention.
Figure 5:
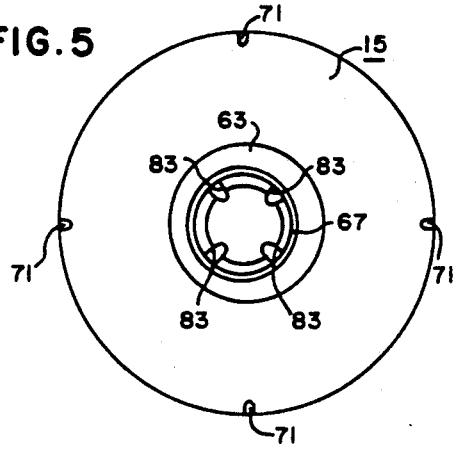
FIG. 5 is a bottom view of the vent cap.
Figure 6:
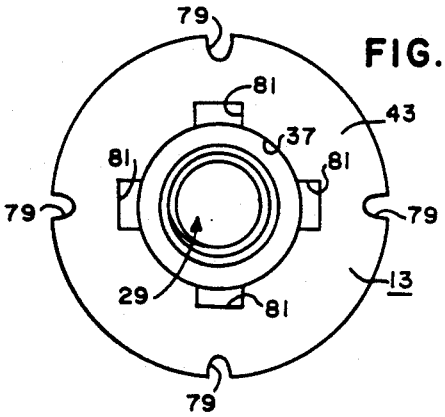
FIG. 6 is a plan view of the vent housing of the present invention.
Figure 7:
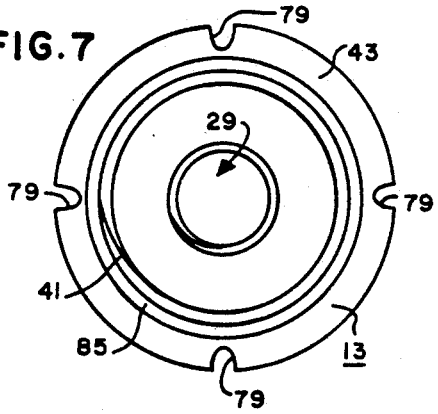
FIG. 7 is a bottom view of the vent housing.
Figure 8:
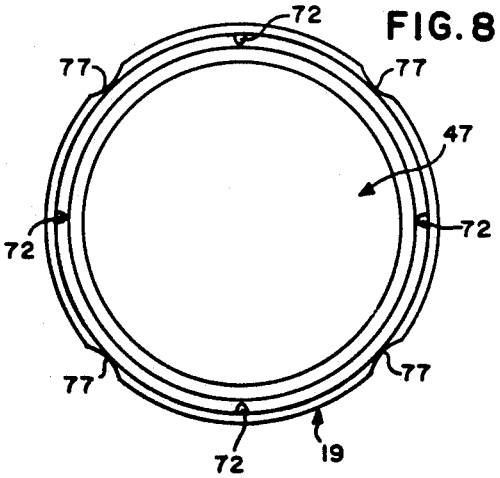
FIG. 8 is a plan view of the ring of the present invention.
Figure 9:
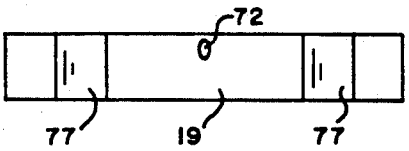
FIG. 9 is a side elevational view of the ring.
Figure 10:
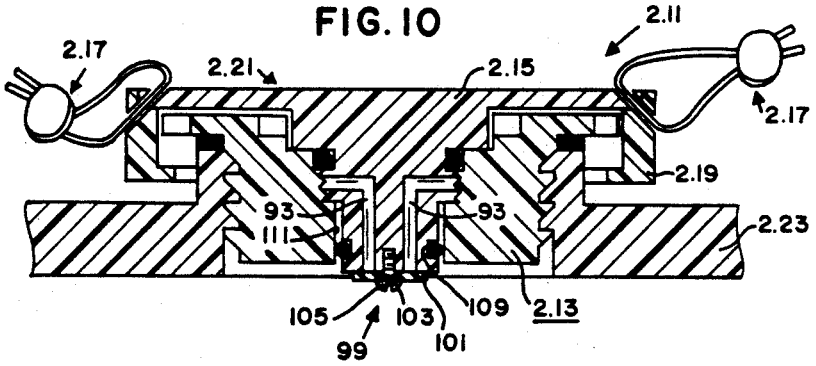
FIG. 10 is a sectional view similar to FIG. 1, but of an alternate embodiment of the present invention shown in a vent closed condition.

In the operation of the vent assembly 11, assuming, for example, that the operator 21 is in a first position and the vent system 11 is in the vent closed condition shown in FIG. 1, it will be understood that when in the vent closed condition, the O-ring 67 is seated against the valve seat 35 and therefore the outside air is prevented from entering container 23, and that the liquid, not shown, in the container is prevented from exiting through the vent assembly 11. Operator 21 is turnable in one direction to the above mentioned first position, in which externally threaded portion 61 of stem 57 is threadedly engaged with internally threaded portion 31 and flow of air is blocked off through passageway means 69 to establish a vent closed condition of vent system 11. In order for the operator to move the vent system 11 into the vent open condition, it is only necessary for the operator to grasp the operator 21 and turn it, using an unscrewing motion, to cause the stem 57 to move upwardly, carrying with it the entire operator 21, until the O-ring 67 becomes disengaged from the unthreaded portion 33 of vent housing 13 and passageway means 69 becomes unblocked, whereupon vent system 11 is in the vent open condition and operator 21 is in a second position shown in FIG. 2. Thus, as will be seen in FIG. 2, when vent system 11 is in said vent open condition, O-ring 67 is unseated and air passageway means 69 is open to permit the flow of air through the passageway means to the interior of container 23, as illustrated by the arrow 89. It will be understood that the passageway means 69 includes the part of portion 45 of opening 47 between the edge of flange 49 and gasket 85, the notches 79, the space 91 between cap 15 and vent housing 13, the notches 83, and opening 29. It shall also be understood that the above-mentioned second position of operator 21 preferably is that in which externally threaded portion 61 is disengaged from internally threaded portion 31, allowing free turning movement of operator 21 relative to vent housing 13.

When the operator desires to place the vent system 11 back into the vent closed condition, the operator again grasps the operator 21 to turn the knob means in the opposite direction from that above described so the threads 61 of stem 57 engage the threads 31 of vent housing 13 to draw the knob means downwardly and cause seating of O-ring 67 onto valve seat 35. It will be understood that it is not necessary to screw the operator 21 very tight to cause sealing, because the O-ring seals without substantial pressure being exerted. This is in contrast to many previous vents wherein it was necessary to use a wrench to effect sealing because a plastic against plastic or a flat gasket seal was used. Furthermore, the large diameter of operator 21 allows the operator to obtain sufficient torque without a wrench. Thus, from the foregoing, it will be understood that the vent system 11 is easy to operate, yet foolproof.

From the foregoing it will also be understood that there is no way to remove the vent system 11 to gain access into the container 23 through the opening 27 without breaking the tamper evident sealing means 17 and unlocking said knob means, i.e., removing cap 15 from ring 19, thereby defining an unlocked condition. Also, it will be evident that vent system 11 may be reused, as for example, after removal during refilling of the container, by simply replacing the sealing means 17, as opposed to a ratchet-type tamper evident vent system which is destroyed when access is gained into the interior of the container.

Additionally, it will be understood that with the vent system 11 of the present invention, even with the vent system in an open vent condition, water, as for example, rain water, is shielded from entering the container 23 through the vent system 11.

Referring now to the alternate embodiment shown in FIGS. 10–14, the vent system 2.11 seen therein is basically the same as vent system 11, and operates in substantially the same way, except for the differences mentioned hereinafter. The parts of vent system 2.11 that correspond to those of vent system 11 will be indicated by like numerals preceded by the numeral "2." in the embodiment of system 2.11. Thus, for example, vent housing 2.13 of embodiment 2.11 corresponds to vent housing 13 of vent system 11. Therefore, the previous description of vent system 11 and its operation should suffice for both embodiments, except for the following described differences.

In vent system 2.11 there is provided an anti-leak feature to prevent leakage of liquid from container 2.23, as for example, in the event that the container accidentally tips. This anti-leakage feature includes one or more conduits 93 drilled or otherwise provided through stem 2.57 from the bottom face of the stem to the side thereof. There are preferably, though not necessarily, four of the conduits 93, each of which extends from a port 95 on the lower face of stem 2.57 to a port 97 on the side of stem 2.57.

A check valve 99 is operably related to passageway means 2.69 for blocking the flow of liquid from container 2.23 through passageway means 2.69 yet permitting passage of air through the passageway means 2.69 when vent system 2.11 is in the vent open condition.

Passageway means 2.69 follows a slightly different path than passageway means 69. Thus, passageway means 2.69 includes the part of portion 2.45 of opening 2.47 between the edge of flange 2.49 and gasket 2.85, the notches 2.79, the space 2.91 between cap 2.15 and vent housing 2.13, conduits 93, and portions of opening 2.29.

Figure 11:
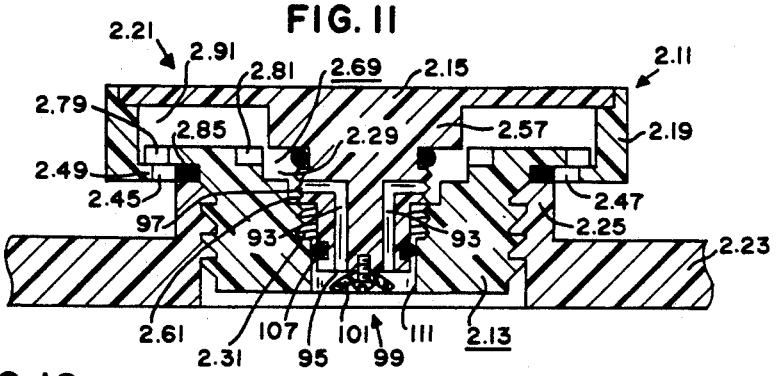
FIG. 11 is a sectional view of the alternate embodiment similar to FIG. 2, with the vent system shown in a vent open condition.
Figure 12:
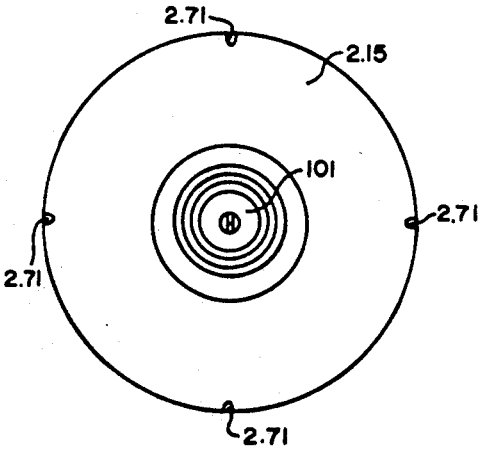
FIG. 12 is a bottom view of the vent cap of the alternate embodiment with the check valve in place.
Figure 13:
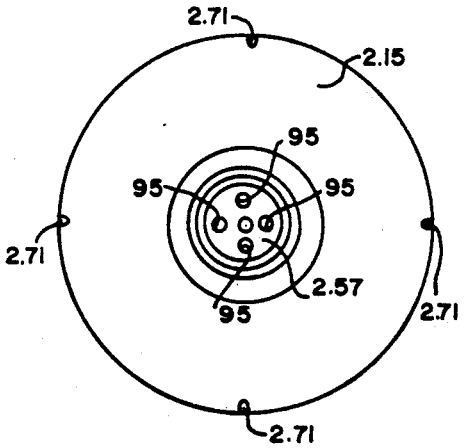
FIG. 13 is a view similar to FIG. 12 of the alternate embodiment, with the check valve removed for purposes of illustration.
Figure 14:
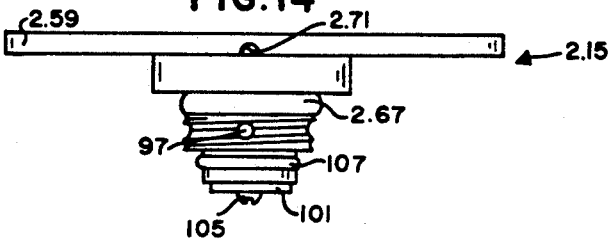
FIG. 14 is a side elevational view of the vent cap of the alternate embodiment.

Check valve 99 preferably include a flapper, preferably in the form of a resilient round disk 101 of rubber or the like, having a hole 103 through which passes a retainer 105, preferably in the form of a screw, extending through hole 103 and threadedly into the lower end of stem 2.57 to hold the center portion of the disk 101 onto the stem 2.57, whereby the disk 101 normally closes the ports 95 to prevent passage of liquid therethrough when the vent system 2.11 is in said vent open condition, but permits flow of air into the inside of container 2.23 when the vent system 2.11 is in said vent open condition. This is illustrated in FIG. 11, wherein it will be seen that the periphery of the disk 101 is able to move downwardly under the force of the air moving into the container.

An O-ring 107 is mounted in a groove 109, provided in stem 2.57, to seal the space between the lower portion of stem 2.57 and the smooth lower wall portion 111 of vent housing 2.13 which defines the lower part of opening 2.29 of the vent housing. Thus, the flow of air will be directed through the conduits 93 rather than between the lower parts of stem 2.57 and wall portion 111. It will be seen in FIGS. 10 and 11 that the internal threads of vent housing 2.13 do not extend to the lower surface of the vent housing but only partially so, as the unthreaded lower wall portion 111 extends the remainder of the way to the lower surface.

It should be noted that both for both vent system embodiments 11, 2.11, the vent system cannot be removed from container 23, 2.23 without removing tamper evident sealing means 17, 2.17. The above noted installation procedure, namely, placing ring 19, 2.19 on the container over neck portion 25, 2.25, then installing vent housing 13, 2.13 with a wrench or standard tool, typically tightening vent housing 13, 2.13 to forty to fifty foot-pounds, and finally, installing cap 15, 2.15 and tamper evident sealing means 17, 2.17, causes vent housing 1 3, 2.13 to be inaccessible for removal, as previously noted. Also, when operator 21, 2.21 is in the second position, preferably with externally threaded portion 61, 2.61 being disengaged from internally threaded portion 31, 2.31, thereby allowing free-turning movement of knob means 21, 2.21 relative to vent housing 13, 2.13, it becomes impossible to generate unscrewing, torque on vent housing 13, 2.13 merely by turning operator 21, 2.21 as the two parts are in disengagement. Additionally, because of the relatively smaller diameters of threaded portions 61, 2.61 and 31, 2.31, coupled with the relatively smooth contacting surfaces between flange 49, 2.49 and vent housing 13, 2.13, it is further impossible to generate unscrewing removal torque on vent housing 13, 2.13 merely by turning operator 21, 2.21. It is thus evident that the only way to remove vent housing 13, 2.13, and therefore, vent system 11, 2.11, from neck portion 25, 2.25 of container 23, 2.23 is to remove tamper evident sealing means 17, 2.17 and, in order, perform the reverse steps of the installation procedure.

Although the present invention has been described and illustrated with respect to a preferred embodiment and a preferred use therefor, it is not to be so limited since modifications and changes can be made therein which are within the full intended scope of the invention.

I claim:

1. A vent system for containers having a threaded opening, said vent system comprising:

a ring having a central opening;

a vent housing including an externally threaded neck portion extending through said central opening of said ring and adapted to threadedly engage the threaded opening of a container, said vent housing having an internally threaded central opening;

a cap including an externally threaded stem;

a passageway extending through said vent system for the passage of air therethrough;

a tamper evident sealing means for locking said cap and said ring together to establish a turnable manual operator, said cap and ring being in a locked condition for blocking access to said vent housing to prevent removal of said vent housing from a container when attached thereto, said operator being turnable in one direction to a first position in which said externally threaded stem is threadedly engaged with said internally threaded central opening of said vent housing for blocking off flow of air through said passageway to establish a vent closed condition of said vent system and turntable in the opposite direction to a second position in which at least a portion of said externally threaded stem is threadedly disengaged from said threads of said vent housing for providing a free turning condition of said operator relative to said vent housing in which said operator is incapable of turning said vent housing and for permitting flow of air through said passageway to establish a vent open condition of said vent system in which communication with the outside atmosphere is established between the outside atmosphere and the interior of a container when attached thereto; and means interacting between said operator and said vent housing for preventing removal of said operator from said vent housing.

2. The vent system of claim 1 in which said central opening of said vent housing includes an enlarged unthreaded portion thereof establishing a valve seat, and in which said stem of said cap includes means for sealing said stem against said valve seat when said operator is in said first position to provide said vent closed condition of said vent system.

3. The vent system of claim 2 in which said vent housing includes a peripheral vent housing flange and in which said ring includes a ring flange adapted to engage said vent housing flange to provide said means interacting between said operator and said vent housing for preventing removal of said operator from said vent housing.

4. The vent system of claim 3 in which said vent housing is provided with a gasket adapted to engage the neck of the container with which used; and in which said vent housing is provided with means for receiving a wrench for tightening said vent housing down against the neck of a container with which used.

5. A vent system for containers of the type having a neck provided with a threaded opening extending into the interior of the container from the outside atmosphere, said vent system comprising:

a ring having a central opening, said ring including a ring flange;

a passageway extending through said vent system for the passage of air therethrough;

a cap including an externally threaded stem;

a vent housing having an internally threaded central opening, said central opening of said vent housing having an enlarged unthreaded portion, and said vent housing including: a peripheral vent housing flange larger in diameter than said central opening of said ring, and an externally threaded neck portion extending though said central opening of said ring and adapted to threadedly engage the threaded opening of the neck of the container to capture said ring on the neck of the container; and a tamper evident sealing means for locking said cap and ring together to establish a turnable manual operator, said cap and ring being in a locked condition blocking access to said vent housing to prevent unwanted removal of said vent housing from a container when attached thereto, said operator being turnable in one direction to a first position in which said externally threaded stem is threadedly engaged with said internally threaded central opening of said vent housing for blocking off flow of air through said passageway to establish a vent closed condition of said vent system and turnable in the opposite direction to a second position in which at least a portion of said externally threaded stem is threadedly disengaged from said threads of said vent housing for providing a free turning condition of said operator relative to said vent housing in which said operator is incapable of turning said vent housing and for permitting flow of air through said passageway to establish a vent open condition of said vent system in which communication with the outside atmosphere is established between the outside atmosphere and the interior of a container when attached thereto.

6. The vent system of claim 1 or claim 5 in which said vent system additionally comprises surface means for inhibiting the substantial transmission of vent housing removal torque from said operator to said vent housing.

7. The vent system of claim 1 in which said vent housing is provided with a gasket adapted to engage the neck of the container with which used; and in which said vent housing is provided with means for receiving a wrench for tightening said vent housing down against the neck of the container with which used.

8. A vent system for containers having a threaded opening, the vent system comprising:

a ring having a central opening;

a vent housing including an externally threaded neck portion extending through the central opening of the ring and adapted to threadedly engage the threaded opening of a container, the vent housing having an internally threaded central opening;

a cap including an externally threaded stem;

a vent passageway extending through the vent system;

a temper-evident means for locking the cap and the ring together, the cap and the ring forming an operator, the operator blocking access to the vent housing to prevent removal of the vent housing from the container, the operator being turnable in one direction to a first position such that the cap stem is threadedly engaged with the internally threaded central opening of the vent housing thereby blocking off flow of air through the vent passageway and the operator being turnable in the opposite direction to a second position such that at least a portion of the cap stem is threadedly disengaged from the threads of the vent housing thereby permitting flow of air through the vent passageway; and securing means interacting between the operator and the vent housing for preventing removal of the operator from the vent housing.

9. The vent system according to claim 8 wherein the securing means comprises a peripheral vent housing flange on the vent housing and a ring flange on the ring, the ring flange adapted to engage the vent housing flange.

10. The vent system of claim 8, further comprising:

surface means for inhibiting the substantial transmission of vent housing removal torque from the operator to the vent housing.

* * * * *

UNITED STATES PATENT AND TRADEMARK OFFICE

CERTIFICATE OF CORRECTION

PATENT NO. : 5,160,054

DATED : November 3, 1992

INVENTOR(S) : Paul A. Nolte

It is certified that error appears in the above—identified patent and that said Letters Patent is hereby corrected as shown below:

Column 5, line 48, delete "knob means" and replace with --operator--

Column 6, line 60, delete "knob means" and replace with --operator--

Column 6, line 63, delete "knob means" and replace with --operator--

Column 7, line 11, delete "knob means" and replace with --operator--

Column 8, line 32, delete "knob means" and replace with --operator--

In claim 7, column 10, line 24, delete "1" and replace with --5--

Signed and Sealed this

Twenty-sixth Day of October, 1993

*Attest:*

*Attesting Officer*

Bruce Lehman

BRUCE LEHMAN

*Commissioner of Patents and Trademarks*